US010686260B2

(12) United States Patent
Wang et al.

(10) Patent No.: US 10,686,260 B2
(45) Date of Patent: Jun. 16, 2020

(54) CABLE CONNECTOR ASSEMBLY WITH WIRE SPACING COMPONENT

(71) Applicant: Molex, LLC, Lisle, IL (US)

(72) Inventors: Meng-Biao Wang, Dongguan (CN); Zhen-Liang Li, Dongguan (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/664,710

(22) Filed: Jul. 31, 2017

(65) Prior Publication Data

US 2018/0048078 A1 Feb. 15, 2018

(30) Foreign Application Priority Data

Aug. 12, 2016 (CN) ..... 2016 1 0664288

(51) Int. Cl.
*H01R 4/02* (2006.01)
*H01R 4/70* (2006.01)
(Continued)

(52) U.S. Cl.
CPC ..... *H01R 4/027* (2013.01); *H01R 4/023* (2013.01); *H01R 4/70* (2013.01); *H01R 13/629* (2013.01);
(Continued)

(58) Field of Classification Search
CPC ..... H01R 4/027; H01R 4/023; H01R 4/70; H01R 13/506; H01R 13/6581;
(Continued)

(56) References Cited

U.S. PATENT DOCUMENTS 6,039,606 A * 3/2000 Chiou ..... H01R 13/506 439/607.45
7,465,194 B1 * 12/2008 Ho ..... H01R 9/032 439/607.01

(Continued)

FOREIGN PATENT DOCUMENTS

CN 2893966 Y 4/2007
CN 201533021 U 7/2010

(Continued)

*Primary Examiner* — Amy Cohen Johnson
*Assistant Examiner* — Paul D Baillargeon
(74) *Attorney, Agent, or Firm* — Molex, LLC

(57) ABSTRACT

The present disclosure provides a cable connector assembly with a wire spacing component, the cable connector assembly comprises a cable connector main body and a locking device sheathing on a periphery of the cable connector main body. The cable connector main body has: a shielding shell; an insulating body received in the shielding shell; a plurality of conductive terminals, the conductive terminals are fixed to the insulating body and have a plurality of soldering tails extending backwardly out from insulating body; a cable, naked ends of a plurality of conductive wires of the cable are correspondingly soldered to the soldering tails; and a wire spacing component, the wire spacing component is provided with a plurality of receiving grooves, the receiving grooves each receive the soldering tail and the naked end of the conductive wire soldered to the soldering tail. The cable connector assembly with the wire spacing component of the present disclosure can prevent short circuit and signal interference of the conductive wires and improve assembling efficiency of the connector.

10 Claims, 7 Drawing Sheets

(51) Int. Cl.

| | |
|---|---|
| ***H01R 13/629*** | (2006.01) |
| ***H01R 13/6581*** | (2011.01) |
| ***H01R 24/60*** | (2011.01) |
| *H01R 107/00* | (2006.01) |

(52) U.S. Cl.
CPC ..... *H01R 13/6581* (2013.01); *H01R 24/60* (2013.01); *H01R 2107/00* (2013.01)

(58) Field of Classification Search
CPC .. H01R 24/60; H01R 13/6583; H01R 13/629; H01R 13/422; H01R 13/627; H01R 13/6271; H01R 13/6272; H01R 13/62911; H01R 13/6273
See application file for complete search history.

(56) References Cited

U.S. PATENT DOCUMENTS

| | | | | |
|---|---|---|---|---|
| 8,460,015 | B2 * | 6/2013 | Deno | H01R 9/0518 174/78 |
| 10,103,498 | B2 * | 10/2018 | Maesoba | H01R 13/516 |
| 2018/0019548 | A1 * | 1/2018 | Maesoba | H01R 13/6473 |

FOREIGN PATENT DOCUMENTS

| | | | |
|---|---|---|---|
| CN | 103474800 | A | 12/2013 |
| CN | 104934813 | A | 9/2015 |
| CN | 204885546 | U | 12/2015 |
| EP | 1653570 | B1 | 8/2011 |
| TW | M309266 | U | 4/2007 |
| TW | M349067 | U | 1/2009 |
| TW | M354916 | U | 4/2009 |

* cited by examiner

CABLE CONNECTOR ASSEMBLY WITH WIRE SPACING COMPONENT

RELATED APPLICATIONS

This application claims priority to Chinese Application No. 201610664288.1, filed Aug. 12, 2016, which is incorporated herein by reference in its entirety.

TECHNICAL FIELD

The present disclosure relates to a cable connector assembly with a wire spacing component, and specifically relates to a Mini-USB cable connector assembly with a wire spacing component which is mounted on such as a vehicle.

BACKGROUND ART

It is generally known that the Mini-USB cable connector is widely used in connection and communication between various electronic equipment as a common USB (Universal Serial Bus) cable connector. Generally, the Mini-USB cable connector achieves transmission of power and signal by the way of soldering conductive terminals of the connector to conductive wires of the cable.

For example, Taiwanese patent TWM354916 discloses an electrical connector. Referring to FIG. 1, the electrical connector comprises an insulating body 5, a plurality of terminals 4 provided to the insulating body 5 and a metal shell surrounding the insulating body 5, the metal shell comprises an upper shell 2 and a lower shell 3 which are latched to each other. The terminals 4 comprises tail portions 43 spaced apart from each other in a height direction, the tail portion 43 is provided with a recessed groove 431, the cable and the terminals 4 are soldered at the recessed grooves 431. Although this technical solution prevents short circuit between the conductive wires of the cable to a certain extent by spacing the tail portions of the terminals apart from each other in the height direction, a disordered dense arrangement between naked ends of the conductive wires may quite possibly cause short circuit and produce signal interference; meanwhile height change of the tail portions of the terminals increases the manufacturing process of the electrical connector, makes the arrangement of the terminals more complicated, makes the manufacturing more difficult and increases the manufacturing cost. Moreover, in the electrical connector as such as one of this technical solution, when the terminals and the cable are soldered, in order to provide insulation protection, it is usually necessary to insert the naked end of each conductive wire into a heat-shrinkable tube, which takes a considerable amount of time, thus affecting assembling efficiency of the connector.

SUMMARY

Therefore, in order to solve the above problem in the prior art, an object of the present disclosure is to provide a cable connector assembly which can prevent short circuit and signal interference of conductive wires and improve assembling efficiency of the connector.

In order to achieve the above object and other advantages, the present disclosure provides a cable connector assembly with a wire spacing component, the cable connector assembly comprises a cable connector main body and a locking device sheathing on a periphery of the cable connector main body. The cable connector main body has: a shielding shell; an insulating body received in the shielding shell; a plurality of conductive terminals, the conductive terminals are fixed to the insulating body and have a plurality of soldering tails extending backwardly out from insulating body; a cable, each naked end of a plurality of conductive wires of the cable is correspondingly soldered to the soldering tail; and a wire spacing component, the wire spacing component is provided with a plurality of receiving grooves, the receiving grooves each receive the soldering tail and the naked end of the conductive wire soldered to the soldering tail.

In an embodiment, the wire spacing component comprises a bottom wall and a plurality of spacing walls extending upwardly from the bottom wall, the spacing walls extend in a front-rear direction and form the receiving grooves.

In an embodiment, the insulating body comprises a housing and a tongue extending forwardly from the housing, the conductive terminals are exposed to an upper surface of the tongue and the soldering tails extend backwardly out from the housing and are spaced apart from each other, the soldering tails are horizontally arranged in a row.

In an embodiment, the wire spacing component is attached to a rear end of the housing, a bottom surface of the wire spacing component and a bottom surface of the housing are generally flush with each other and are attached to an inner surface of the shielding shell, the naked end of each conductive wire is interposed between the soldering tail and the bottom wall of the wire spacing component.

In an embodiment, the shielding shell comprises a first shielding shell and a second shielding shell latching with the first shielding shell, the first shielding shell comprises an insertion portion and a receiving portion positioned behind the insertion portion, two side surfaces of the receiving portion each are provided with an elastic latching piece protruding inwardly, the elastic latching piece abuts against a rear end of the housing of the insulating body to prevent the insulating body from being detached backwardly.

In an embodiment, the first shielding shell has a first latching portion, the second shielding shell has a second latching portion, the first shielding shell is connected with the second shielding shell together by latching between the first latching portion and the second latching portion.

In an embodiment, the first shielding shell comprises a stepped portion with a certain height difference, a lower part of the stepped portion receives a front end of the housing, a higher part of the stepped portion receives the rear end of the housing.

In an embodiment, the locking device is provided with a receiving cavity, the cable connector main body is inserted into and fixed in the receiving cavity.

In an embodiment, the locking device is provided with a press key and a latching member positioned in the front of the press key; when the press key is pressed down, the latching member moves upwardly, so that the locking device is inserted into an equipment; when the press key is released, the latching member rebounds downwardly, the locking device and the cable connector main body are locked to the equipment.

In an embodiment, the cable connector assembly further comprises an insulating outer shell covering the cable connector main body, two side surfaces of the insulating outer shell are provided with a plurality of sliding grooves correspondingly matching with the receiving cavity of the locking device.

The advantageous effect of the present invention lies in that, the wire spacing component of the present disclosure separates the soldering tails 1310 of the conductive terminals together with the conductive wires soldered thereto from each other, preventing the naked end of the conductive wires from contacting together, so that effectively avoiding short circuit and signal interference caused by a disordered dense arrangement between the conductive wires of the cable connector assembly; moreover, the soldering tails are formed by that the conductive terminals straightly extend backwardly out from the housing and horizontally arranged in a row, so it is no need to further bend or extend upwardly or downwardly to a certain height, thereby simplifying the manufacturing process, improving the manufacturing efficiency, and saving the manufacturing cost. Also, because the wire spacing component is provided, it is no need to provide insulation protection when the conductive wires are soldered to the soldering tails of the conductive terminals, thus it is not necessary to insert the naked end of the conductive wire into a heat-shrinkable tube before soldering, thereby greatly reducing the assembling time and improving the assembling efficiency of the cable connector assembly. The locking device may conveniently lock the cable connector body to such as a vehicle.

BRIEF DESCRIPTION OF THE DRAWINGS

The present disclosure may better be understood by reference to the following Detailed Description, taken in connection with the accompanying Figures, in which the same reference numeral identifies the same component, and in which.

DETAILED DESCRIPTION OF THE PREFERRED EMBODIMENTS

Hereinafter the present disclosure will be described in detail with reference to the Figures.

Figure 1:
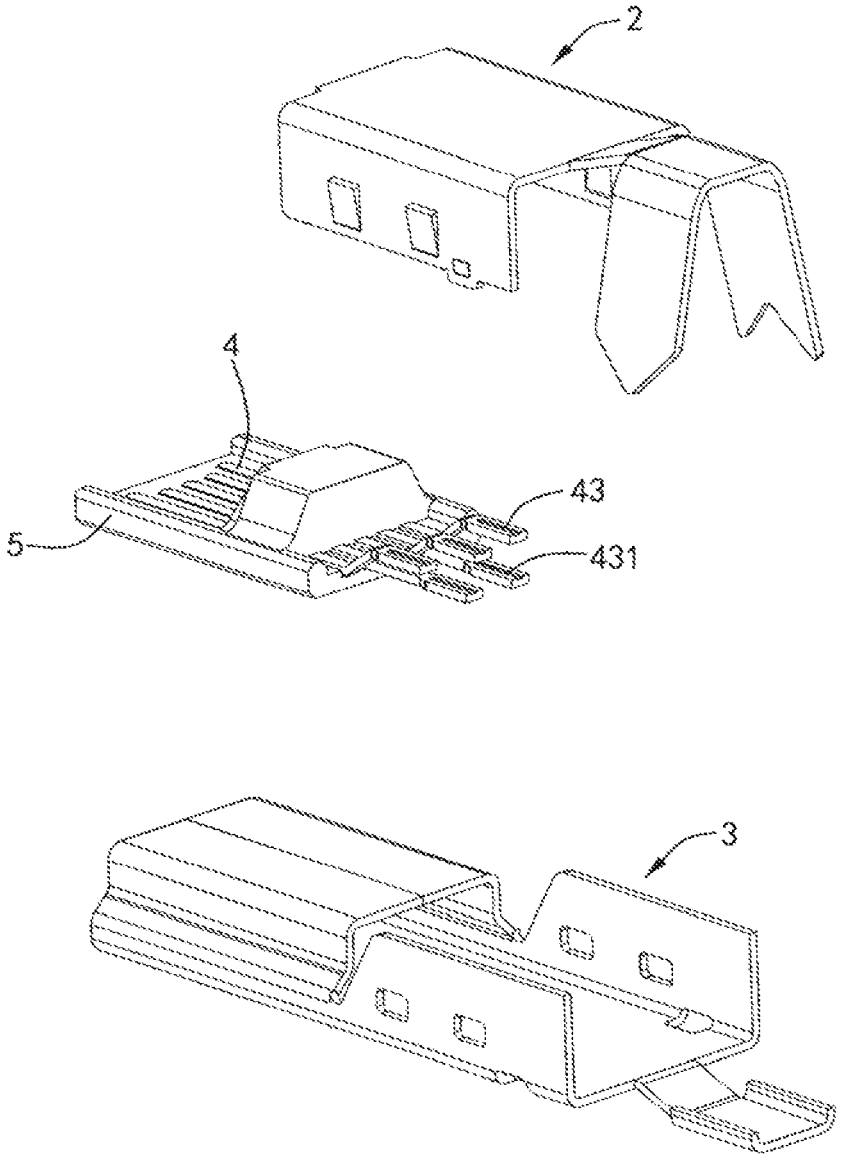
FIG. 1 is an exploded perspective view of an electrical connector in the prior art.
Figure 2:
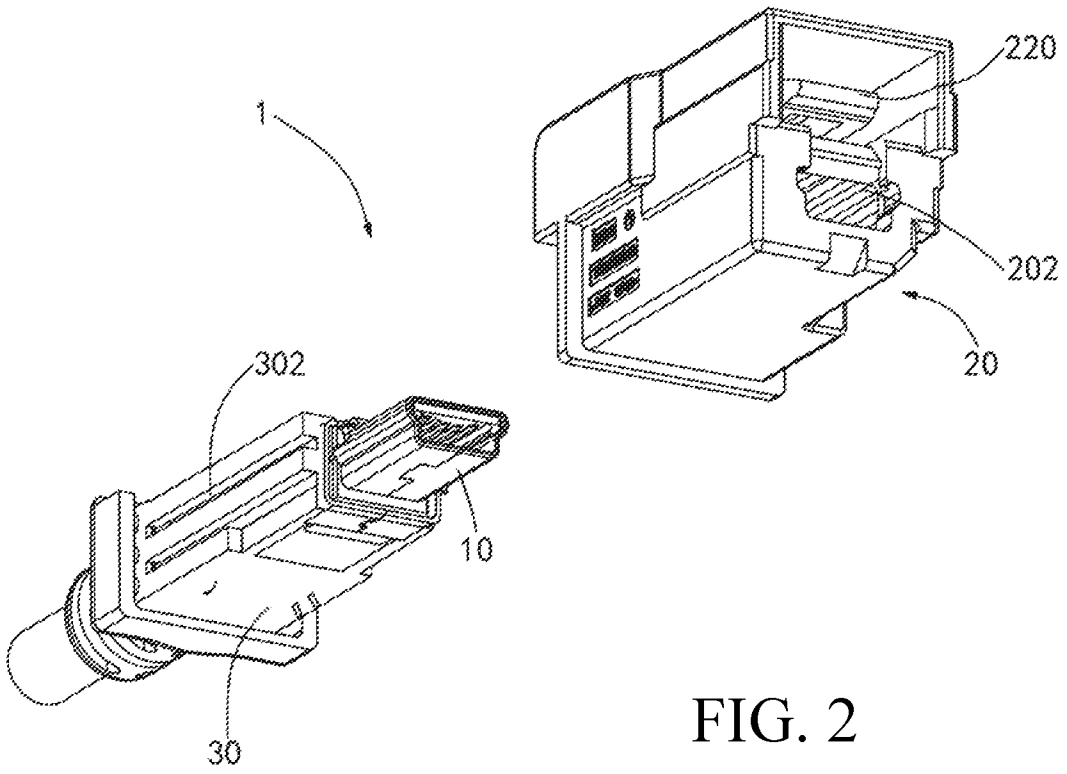
FIG. 2 is a perspective view of a cable connector assembly according to an embodiment of the present disclosure in a state that a cable connector main body is separated from a locking device.
Figure 3:
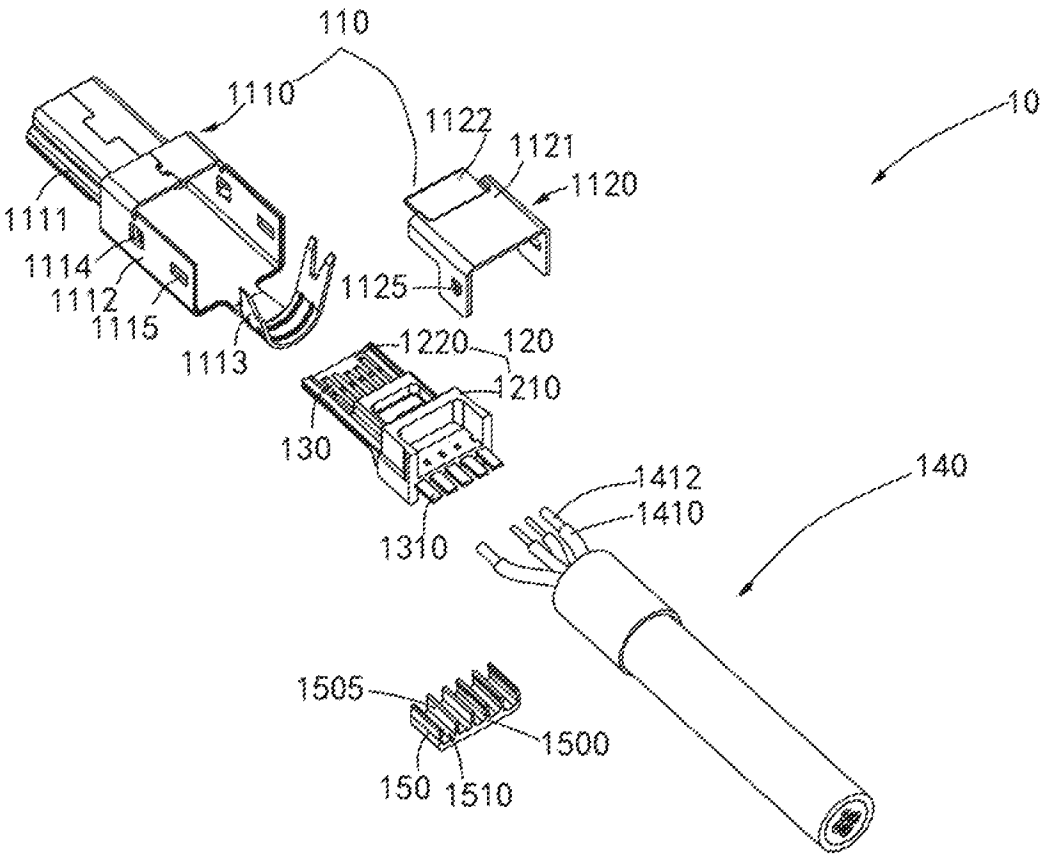
FIG. 3 is an exploded perspective view of the cable connector main body according to the embodiment of the present disclosure.

FIG. 2 is a perspective view of a cable connector assembly 1 according to an embodiment of the present disclosure in a state that a cable connector main body 10 is separated from a locking device 20; FIG. 3 is an exploded perspective view of the cable connector main body 10 according to the embodiment of the present disclosure.

As shown in FIG. 2 and FIG. 3, a cable connector assembly 1 of the present disclosure generally comprises a cable connector main body 10, an insulating outer shell 30 formed to cover the cable connector main body 10 (which is more clearly shown in FIG. 6 below) and a locking device 20 sheathing on a periphery of the cable connector main body 10. The cable connector main body 10 of the present disclosure generally comprises a shielding shell 110, an insulating body 120 received in the shielding shell 110, a plurality of conductive terminals 130 fixed to the insulating body 120, a cable 140 connected to rear ends of the conductive terminals 130 by the way of soldering and a wire spacing component 150.

Figure 4:
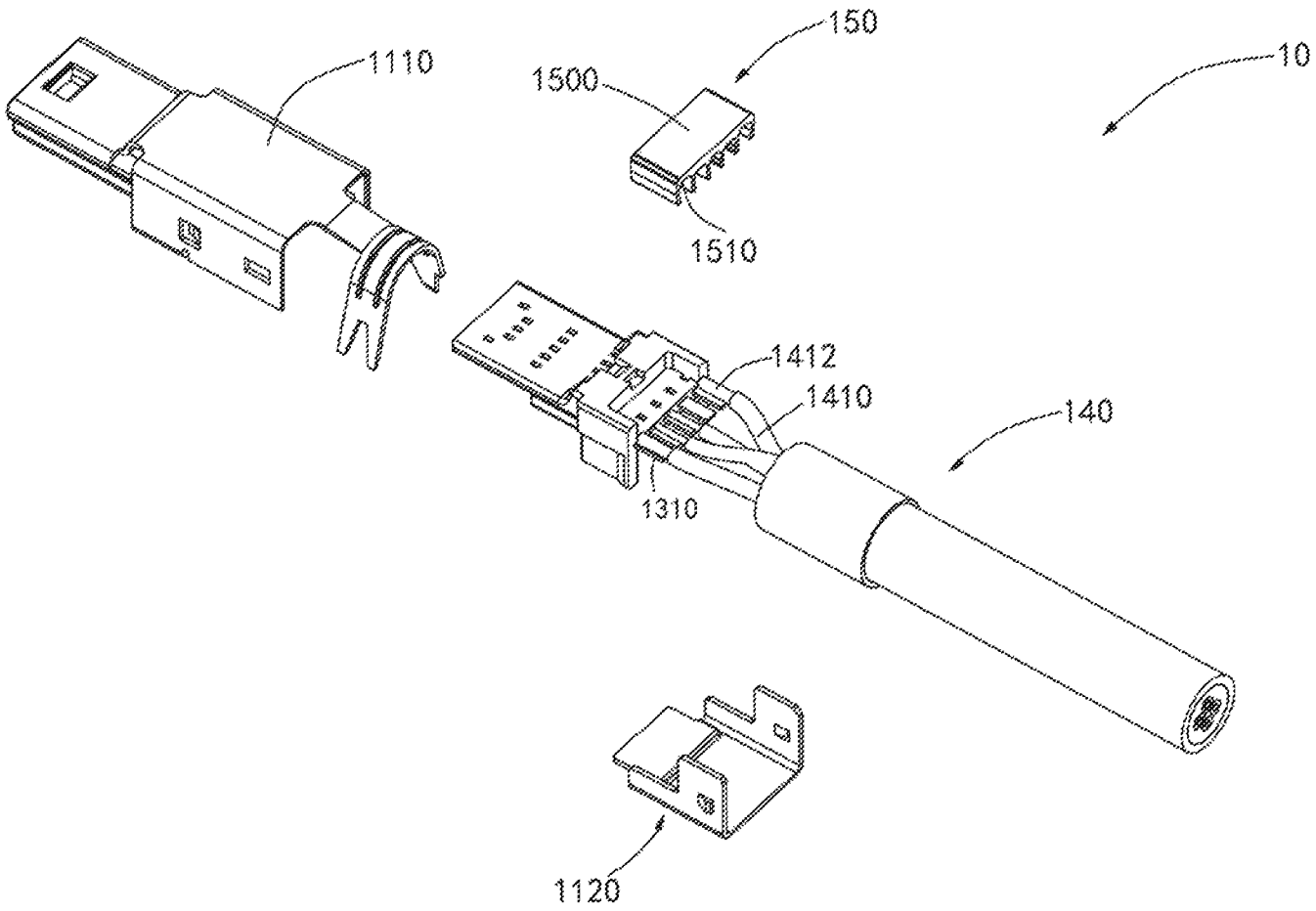
FIG. 4 is a perspective view of the cable connector main body according to the embodiment of the present disclosure after a plurality of conductive wires and a plurality of conductive terminals are correspondingly soldered.
Figure 5:
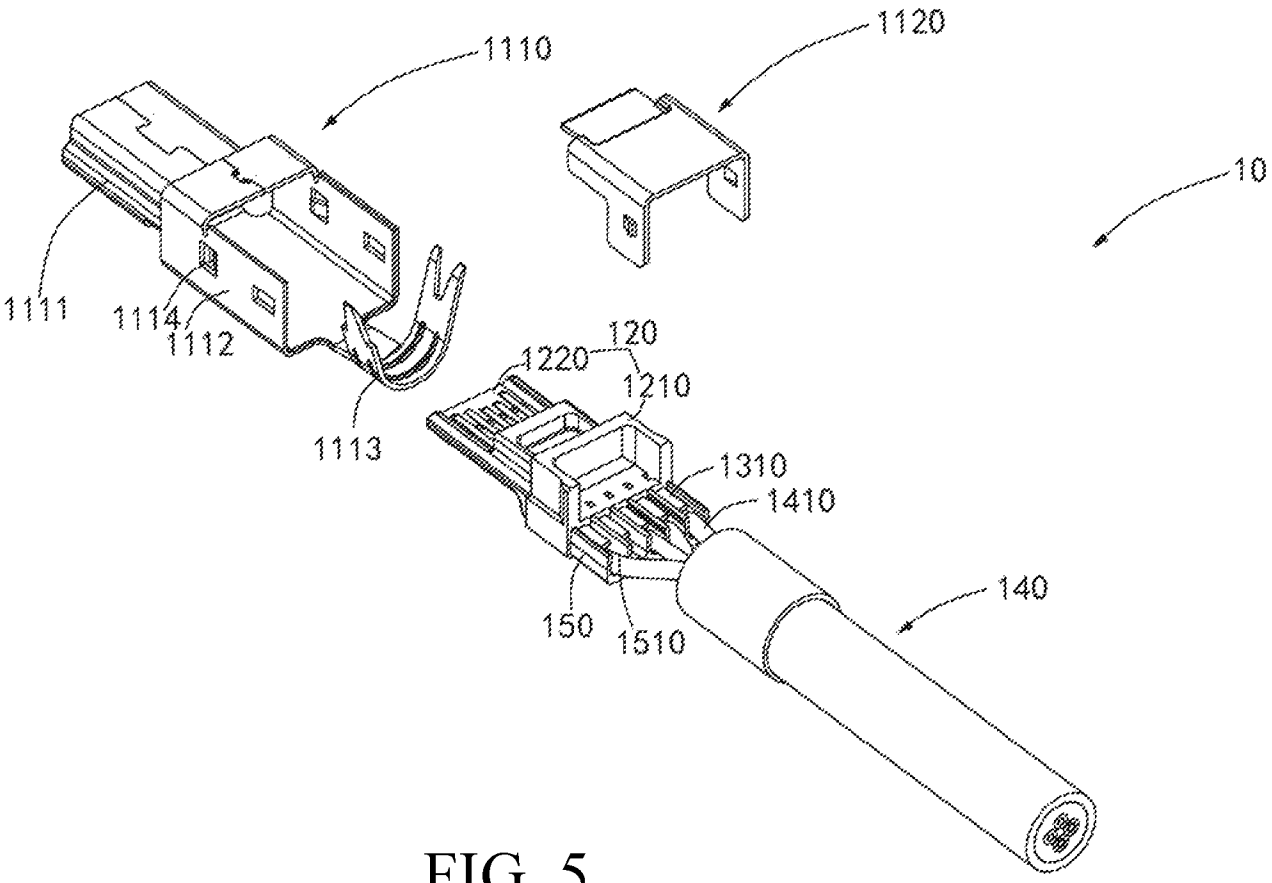
FIG. 5 is a perspective view of the cable connector main body after a wire spacing component is mounted on the basis of FIG. 4.

As shown in FIG. 3, FIG. 4 and FIG. 5, the insulating body 120 of the cable connector main body 10 comprises a housing 1210 and a tongue 1220 extending forwardly from the housing 1210. In an embodiment, the housing 1210 is designed to have a stepped portion with a certain height difference, one end of the stepped portion close to the tongue 1220 is lower and the other end of the stepped portion is higher. The conductive terminals 130 are exposed to an upper surface of the tongue 1220 of the insulating body 120 and extend backwardly through the housing 1210, and have a plurality of soldering tails 1310 which extend backwardly out from the housing 1210 and are spaced apart from each other. The soldering tails 1310 are horizontally arranged in a row, the soldering tails 1310 are used to be correspondingly soldered to naked ends 1412 of a plurality of conductive wires 1410 of the cable 140, in some embodiments, the number of the soldering tails may be greater than or equal to the number of the conductive wires. A wire spacing component 150 is provided with respect to soldered parts between the soldering tails 1310 and the conductive wires 1410. The wire spacing component 150 comprises a bottom wall 1500 and a plurality of spacing walls 1505 extending upwardly from the bottom wall 1500, the spacing walls 1505 extend in parallel along a front-rear direction and forms a plurality of receiving grooves 1510, the receiving grooves 1510 each receive the soldering tail 1310 and the naked end 1412 of the conductive wire 1410 soldered to the soldering tail 1310, so that the soldering tails 1310 together with the naked end 1412 of the conductive wires 1410 are separated from each other, preventing the naked ends 1412 of the conductive wires 1410 from contacting each other, thereby effectively avoiding short circuit and signal interference caused by a disordered dense arrangement between the conductive wires 1410 of the cable connector assembly. The naked end 1412 of each conductive wire 1410 is interposed between the soldering tail 1310 and the bottom wall 1500 of the wire spacing component 150, thereby preventing the naked end 1412 from being detached unexpectedly. Also, the soldering tails 1310 are formed by that the conductive terminals 130 straightly extend backwardly out from the housing 1210, so it is no need to further bend or extend upwardly or downwardly to a certain height like the prior art, thereby simplifying the manufacturing process, improving the manufacturing efficiency, and saving the manufacturing cost.

The shielding shell 110 of the cable connector main body 10 comprises a first shielding shell 1110 and a second shielding shell 1120. In an embodiment, the first shielding shell 1110 comprises an insertion portion 1111, a receiving portion 1112 and a cable crimp 1113 extending backwardly from the receiving portion 1112 and used to fix the cable 140. A stepped portion with a certain height difference is formed between the insertion portion 1111 and the receiving portion 1112, so as to match with the corresponding stepped portion of the housing 1210 mentioned above when mounted. A bottom surface and two side surfaces of the receiving portion 1112 are closed, only a top surface of the receiving portion 1112 is open. The two side surfaces of the receiving portion 1112 each are provided with an elastic latching piece 1114 protruding inwardly and a latching hole 1115, the elastic latching pieces 1114 are provided in pairs on the two opposite side surfaces of the receiving portion 1112 close to the insertion portion 1111, the latching holes 1115 are provided in pairs on the two opposite side surfaces of the receiving portion 1112 close to the cable crimp 1113. The second shielding shell 1120 has a top surface 1121 and an extending piece 1122 bending forwardly and downwardly from the top surface 1121 and extending, and two opposite side walls of the second shielding shell 1120 each are provided with a protrusion 1125 corresponding to the latching hole 1115. Certainly, in other embodiments, the shape, position and the like of the above structure may be varied, for example, the first shielding shell 1110 does not have the cable crimp 1113 but the second shielding shell 1120 has the cable crimp 1113, the second shielding shell 1120 has the latching hole 1115 but the first shielding shell 1110 has the protrusion 1125. Meanwhile, any suitable changes can also be made with respect to shape, number, position and size of the elastic latching piece, the latching hole and the protrusion.

Figure 6:
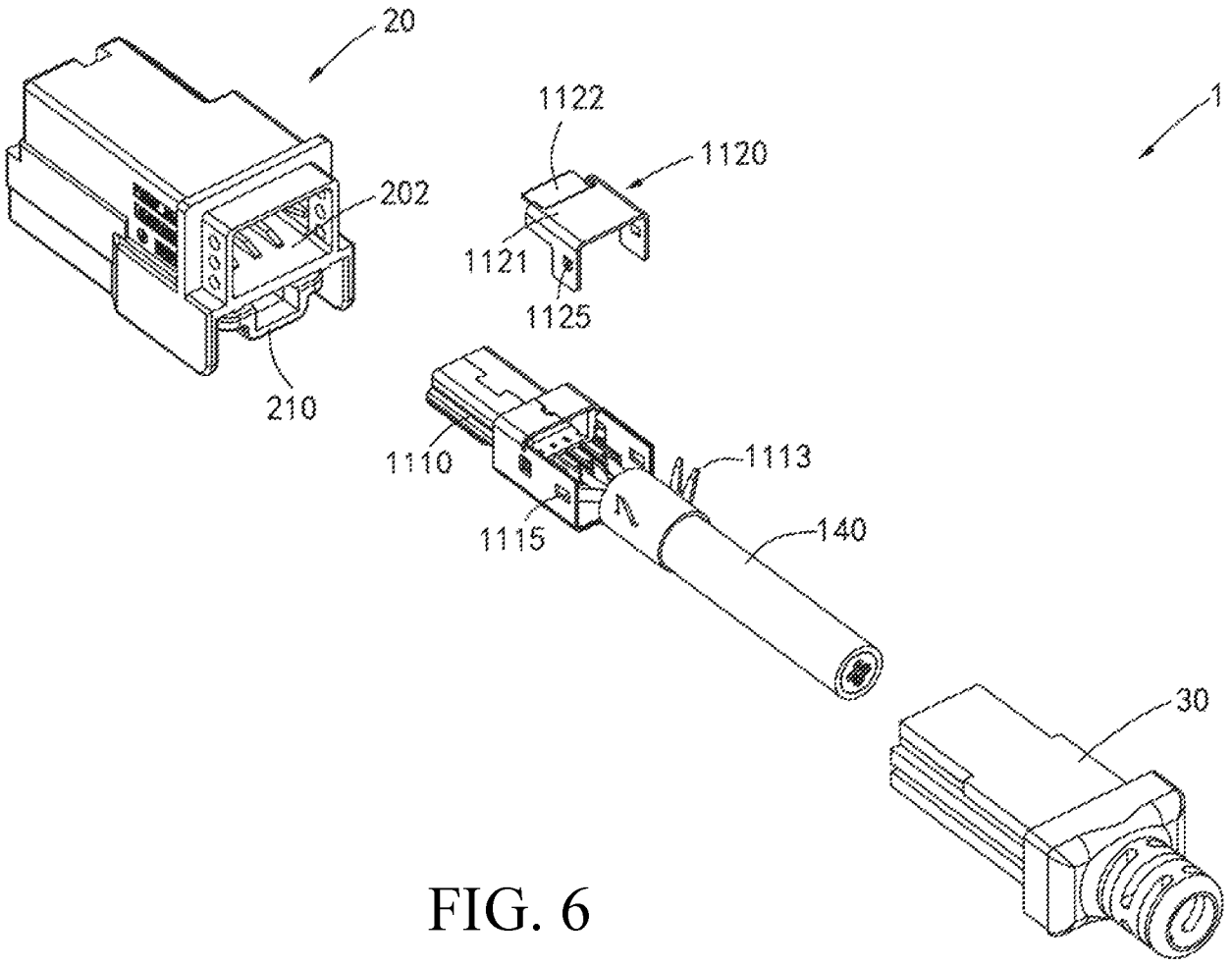
FIG. 6 is a perspective view of the cable connector assembly on which a first shielding shell is mounted on the basis of FIG. 5, and into which an insulating outer shell and a locking device are added.
Figure 7:
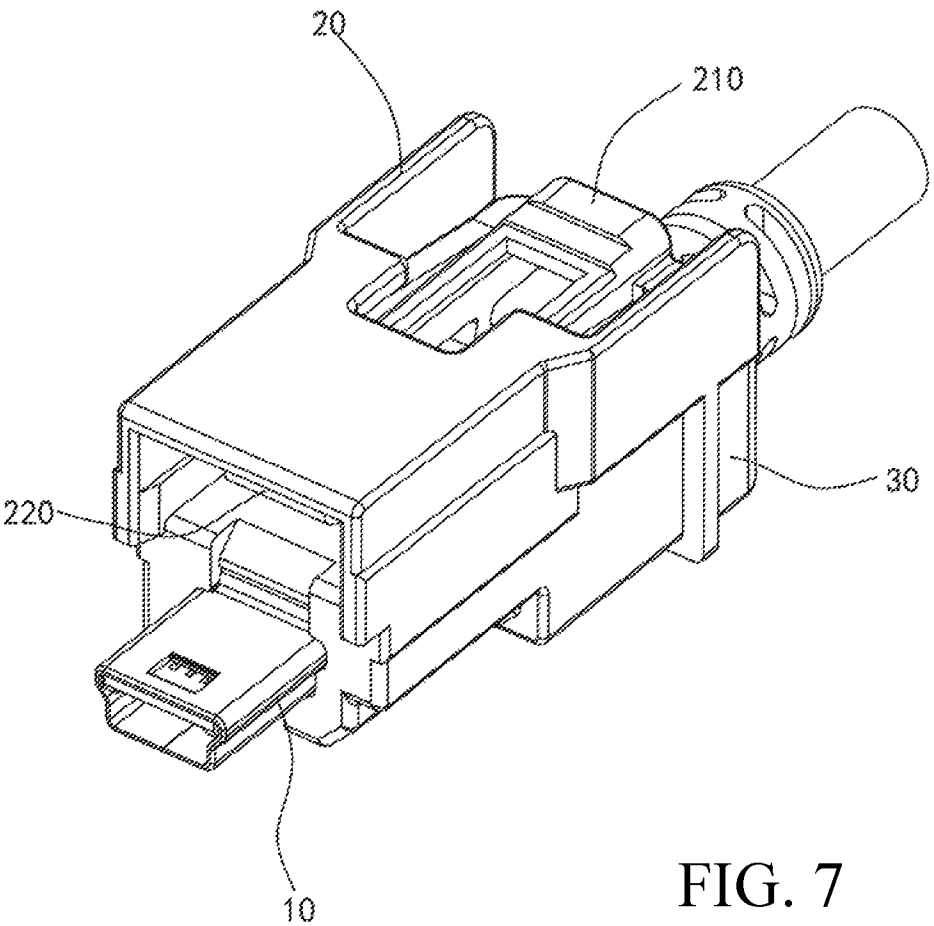
FIG. 7 is a perspective view after the cable connector assembly of the embodiment of the present disclosure has been mounted.

FIG. 4 is a perspective view of the cable connector main body 10 according to the embodiment of the present disclosure after a plurality of conductive wires 1410 and a plurality of conductive terminals 1310 are correspondingly soldered; FIG. 5 is a perspective view of the cable connector main body 10 after a wire spacing component 150 is mounted on the basis of FIG. 4; FIG. 6 is a perspective view of the cable connector assembly 1 on which a first shielding shell 1110 is mounted on the basis of FIG. 5, and into which an insulating outer shell 30 and a locking device 20 are added; FIG. 7 is a perspective view after the cable connector assembly 1 of the embodiment of the present disclosure has been mounted.

An assembling process of the cable connector assembly with the wire spacing component of the embodiment will be described below with reference to FIG. 2 to FIG. 7. Firstly, as shown in FIG. 3 and FIG. 4, the conductive wires 1410 are respectively soldered to bottom surfaces of the soldering tails 1310 (taking the orientation in FIG. 3); then, as shown in FIG. 4 and FIG. 5, at the connected parts between the conductive wires 1410 and the soldering tails 1310, the wire spacing component 150 is attached to a rear end of the housing 1210 of the insulating body 120, a bottom surface of the wire spacing component 150 is generally flush with a bottom surface of the housing 1210, so that each receiving groove 1510 receives one soldering tail 1310 and the naked end 1412 of one conductive wire 1410 soldered together with the one soldering tail 1310, thereby the short circuit and interference possibly caused by the disordered dense arrangement between the conductive wires 1410 of the cable connector assembly 1 can be effectively avoided; as shown in FIG. 5 and FIG. 6, the insulating body 120 is allowed to press down the elastic latching piece 1114 of the first shielding shell 1110, and insert forwardly the insertion portion 1111 until the elastic latching piece 1114 rebounds after the housing 1210 of the insulating body 120 enters completely, therefore the elastic latching piece 1114 abuts against the rear end of the housing 1210, at this time the stepped portion of the first shielding shell 1110 just matches with the stepped portion of the housing 1210 of the insulating body 120, the bottom surface of the wire spacing component 150 and the bottom surface of the housing 1210 which are generally flush with each other are attached to an inner surface of the first shielding shell 1110 and thus are positioned, thereby making the insertion portion 1111 receive the tongue 1220 of the insulating body 120, the receiving portion 1112 receive the wire spacing component 150 and the conductive wires 1410, the cable crimp 1113 surround a periphery of the cable 140, so that the insulating body 120 is fixed in the first shielding shell 1110; as shown in FIG. 6, the second shielding shell 1120 is mounted to the first shielding shell 1110 from top to bottom, the extending piece 1122 is inserted into an upper space formed after the first shielding shell 1110 and the insulating body 120 are mounted, meanwhile the protrusion 1125 is aligned with and pushed down into the latching hole 1115, so that the second shielding shell 1120 is fixed, then a pressure is applied to the cable crimp 1113 to make the cable crimp 1113 deformed so as to crimp the cable 140, thereby forming the cable connector main body 10. Optionally, the insulating outer shell 30 may be formed to cover a rear portion of the shielding shell 110 of the cable connector main body 10, so as to further protect the connected parts between the cable 140 and the conductive terminals 130, two side surfaces of a front portion of the insulating outer shell 30 are provided with a plurality of sliding grooves 302 correspondingly matching with receiving cavities 202 of the locking device 20, the sliding grooves 302 extend horizontally so that the insulating outer shell 30 may be smoothly pushed into the receiving cavity 202 of the locking device 20 and help for positioning.

Referring to FIG. 2 and FIG. 7, the locking device 20 of the cable connector assembly 1 of the present disclosure is used to fix the cable connector main body 10 to a corresponding equipment (not shown, for example a vehicle). The locking device 20 is provided with a receiving cavity 202, the cable connector main body 10 is inserted into and fixed in the receiving cavity 202. The locking device 20 is provided with a press key 210 and a latching member 220 positioned on a front end of the press key 210. The press key 210 may be pressed down so as to make the latching member 220 move up and down. When the press key 210 is pressed down, the latching member 220 moves upwardly, so that the locking device 20 can be smoothly inserted into a corresponding equipment; then when the press key 210 is released, the latching member 220 rebounds downwardly, so that the locking device 20 together with the cable connector main body 10 are locked to the corresponding equipment. The locking device 20 makes mounting of the cable connector main body 10 very simple and convenient.

In the present disclosure, because the wire spacing component 150 is provided, after the conductive wires 1410 are correspondingly soldered to the soldering tails 1310 of the conductive terminals 130, only one wire spacing component 150 is needed to mount so as to separate the naked ends 1412 of all the conductive wires 1410 from each other, it is not necessary to insert the naked ends 1412 of the conductive wires 1410 into heat-shrinkable tubes (not shown) one by one before soldering so as to provide insulation, thereby greatly reducing assembling time, improving assembling efficiency of the cable connector assembly 1. Taking the actual operation as an example, when the cable connector assembly of the prior art is assembled, that the conductive wires 1410 are respectively inserted into the heat-shrinkable tubes and then soldered to the conductive terminals 130 together takes about 28 seconds; but when the cable connector assembly of the present disclosure is assembled, the conductive wires 1410 are directly soldered to the conductive terminals 130 respectively and then the wire spacing component 150 is mounted, this process only takes about 19 seconds.

The construction and the assembling process of the cable connector assembly with the wire spacing component of the embodiment according to the present disclosure as described above are only exemplary, it may have various modifications and variations. For example, the shape, construction and connection of the components, such as the housing, the shielding shell and the like may be in any suitable form.

It should be understood that while a preferred embodiment of the Present Disclosure is shown and described as above, the present disclosure is not limited to the specific embodiment described above, those skilled in the art may devise various modifications and variations without departing from the spirit and scope of the appended Claims. Therefore, it should be noted that various modifications and variations cannot be considered to be independent of the technical spirit and expectations of the present disclosure.

What is claimed is:

1. A cable connector assembly with a wire spacing component, the cable connector assembly comprising:

a cable connector main body and a locking device sheathing on a periphery of the cable connector main body, the cable connector main body having a shielding shell and an insulating body received in the shielding shell;

a plurality of conductive terminals, the conductive terminals being fixed to the insulating body and having a plurality of soldering tails extending backwardly out from insulating body;

a cable, each naked end of a plurality of conductive wires of the cable being correspondingly soldered to the soldering tail; and a wire spacing component, the wire spacing component being provided with a plurality of receiving grooves, the receiving grooves each receiving the soldering tail and the naked end of the conductive wire soldered to the soldering tail, wherein the wire spacing component comprises a bottom wall and the naked end of each conductive wire is interposed between the soldering tail and the bottom wall of the wire spacing component.

2. The cable connector assembly according to claim 1, wherein the wire spacing component comprises a plurality of spacing walls extending upwardly from the bottom wall, the spacing walls extend in a front-rear direction and form the receiving grooves.

3. The cable connector assembly according to claim 2, wherein the insulating body comprises a housing and a tongue extending forwardly from the housing, the conductive terminals are exposed to an upper surface of the tongue and the soldering tails extend backwardly out from the housing and are spaced apart from each other, the soldering tails are horizontally arranged in a row.

4. The cable connector assembly according to claim 3, wherein the wire spacing component is attached to a rear end of the housing, a bottom surface of the wire spacing component and a bottom surface of the housing are generally flush with each other and are attached to an inner surface of the shielding shell.

5. The cable connector assembly according to claim 3, wherein the shielding shell comprises a first shielding shell and a second shielding shell latching with the first shielding shell, the first shielding shell comprises an insertion portion and a receiving portion positioned behind the insertion portion, two side surfaces of the receiving portion each are provided with an elastic latching piece protruding inwardly, the elastic latching piece abuts against a rear end of the housing of the insulating body to prevent the insulating body from being detached backwardly.

6. The cable connector assembly according to claim 5, wherein the first shielding shell has a first latching portion, the second shielding shell has a second latching portion, the first shielding shell is connected with the second shielding shell together by latching between the first latching portion and the second latching portion.

7. The cable connector assembly according to claim 6, wherein the first shielding shell comprises a stepped portion with a certain height difference, a lower part of the stepped portion receives a front end of the housing, a higher part of the stepped portion receives the rear end of the housing.

8. The cable connector assembly according to claim 1, wherein the locking device is provided with a receiving cavity, the cable connector main body is inserted into and fixed in the receiving cavity.

9. The cable connector assembly according to claim 8, wherein the locking device is provided with a press key and a latching member positioned in the front of the press key; when the press key is pressed down, the latching member moves upwardly, so that the locking device is inserted into an equipment; when the press key is released, the latching member rebounds downwardly, the locking device and the cable connector main body are locked to the equipment.

10. The cable connector assembly according to claim 8, wherein the cable connector assembly further comprises an insulating outer shell covering the cable connector main body, two side surfaces of the insulating outer shell are provided with a plurality of sliding grooves correspondingly matching with the receiving cavity of the locking device.

* * * * *